United States Patent [19]

Pessina et al.

[11] Patent Number: 4,611,801

[45] Date of Patent: Sep. 16, 1986

[54] ACCUMULATING CONVEYOR DEVICE

[76] Inventors: Giorgio Pessina; Aldo Perobelli, both of Via Timavo, 32, 30137 Paderno Dugnano (Milano), Italy

[21] Appl. No.: 702,148

[22] Filed: Feb. 15, 1985

[30] Foreign Application Priority Data

Mar. 22, 1984 [IT] Italy ..... 20197 A/84

[51] Int. Cl.[4] ..... B65H 1/02

[52] U.S. Cl. ..... 271/150; 198/423; 198/425

[58] Field of Search ..... 271/150, 149, 147, 129, 271/157, 158, 159, 160; 414/330; 198/779, 423, 425

[56] References Cited

U.S. PATENT DOCUMENTS

| | | | |
|---|---|---|---|
| 3,459,420 | 8/1969 | Huntwork | 271/150 |
| 4,052,052 | 10/1977 | Müller | 271/150 X |
| 4,271,960 | 6/1981 | Chalich | 198/779 |

*Primary Examiner*—Bruce H. Stoner, Jr.
*Assistant Examiner*—Lawrence J. Goffney, Jr.
*Attorney, Agent, or Firm*—Bucknam and Archer

[57] ABSTRACT

The present invention is constituted by a device which acts, simultaneously, as an accumulation member for pacts of signatures (15) and as a device for conveying these latter to subsequent working stages. The device comprises a structure (20) supporting at least one pair of shafts (1,2), disposed horizontally and provided each with a pair of sprockets (3,4; 5,6), over which pass special conveyor chains (7,8) constituted by articulated links (9) capable of rotating about articulation pins (10) and some of the pins (10) supporting pairs of pulleys (11,12), suitably spaced, and disposed on the same side or, alternatively, on opposite sides of the chain itself. The pulleys (11,12) have a diameter such that they project above the links (9) and longitudinally adjacent pairs of pulleys (11,12) carry belts (16) which also project above the chain links (9) to provide a support surface on which the signatures can rest. The chains are driven faster than the required conveying speed and the pulleys can turn individually to allow the packs of signatures to accumulate.

7 Claims, 3 Drawing Figures

ACCUMULATING CONVEYOR DEVICE

The present invention relates generally to an accumulation/conveyor device, which is particularly, but not exclusively, adapted for conveying and/or accumulating stacks of signatures.

As is known, during the various stages of producing bound printed material and, more generally, during the various working stages for manipulation of packs of signatures, there are in many cases currently disposed sideways on beds and made to advance by utilizing conveyor belts in such a way as to load the signatures onto various operating machines positioned downstream of the conveyor.

The said packs of signatures are normally preliminarily pressed, and held between pairs of boards of wood and held by straps. Such packs of signatures must be maintained together and positioned sideways with the signatures vertical before the individual signatures are introduced into the various subsequent operating machines. In order to be able to obtain this result it is necessary to apply to the signatures a certain force in a direction such as to advance them for introduction into the subsequent operating machines without damage in any way to the sheets which, as mentioned above, must be disposed sideways.

Moreover, the individual signatures at the leading end of the stack must be unstressed so as to be able progressively to slip down to a horizontal position for the purpose of becoming spaced and then withdrawn one at a time without the risk of simultaneous introduction of more than one adjacent signature which might cause obstructions to the various operating machines downstream of the supply device.

Such a result has not until now been achieved in an automatic and reliable manner, notwithstanding the significant efforts made by those skilled in the art to resolve the problems involved.

The present invention seeks therefore to provide an accumulation and conveyor device for the automatic accumulation and conveying of signatures to the subsequent working operations, which will be very simple and therefore inexpensive to produce and which will be economical to maintain.

According to the present invention, there is provided an accumulator conveyor device for simultaneously conveying and accumulating packs of signatures for feeding to a subsequent working stage, characterised by the fact that it comprises a support structure carrying at least a pair of shafts disposed horizontally and each provided with at least a pair of sprockets over which pass special conveyor chains constituted by articulated links pivotally connected by articulation pins, at least some of the articulation pins carrying a pair of pulleys, longitudinally adjacent pairs of pulleys being joined by loop members defining support surfaces for the packs of signatures.

An advantage of the device of the present invention lies in the fact that it is highly reliable because the operating members are subjected to practically no wear, and are nevertheless able to cause the individual signature's advance in the conveying direction in an extremely delicate and certain manner at the correct feed speed for the subsequent machinery.

The device of the present invention permits packs of signatures which have previously been pressed between pairs of boards and tied with straps, to be conveyed and at the same to be loosened on an extended support plane so that the individual signatures can become separated from one another to be removed from the conveyor one at a time.

The various individual signatures, after having been freed from the said preliminary wrapped packs, are made to advance at a suitable speed by driving the special conveyor chains by conventional driving means. These chains have articulated links which can turn about suitable articulation pins, and at least some of the said links support pulleys or pairs of pulleys suitably spaced and disposed either on the same side or, alternatively, on opposite sides of the link of the chain on which they are carried.

Each pulley is independently turnable on its pivot pin and longitudinally adjacent pulleys are joined in pairs by flexible belts, webs, wires, cables or chains turnable with the said pair of pulleys on which they are carried.

Two embodiments of the present invention will now be more particularly described, by way of example, with reference to the accompanying drawings in which.

Figure 1:
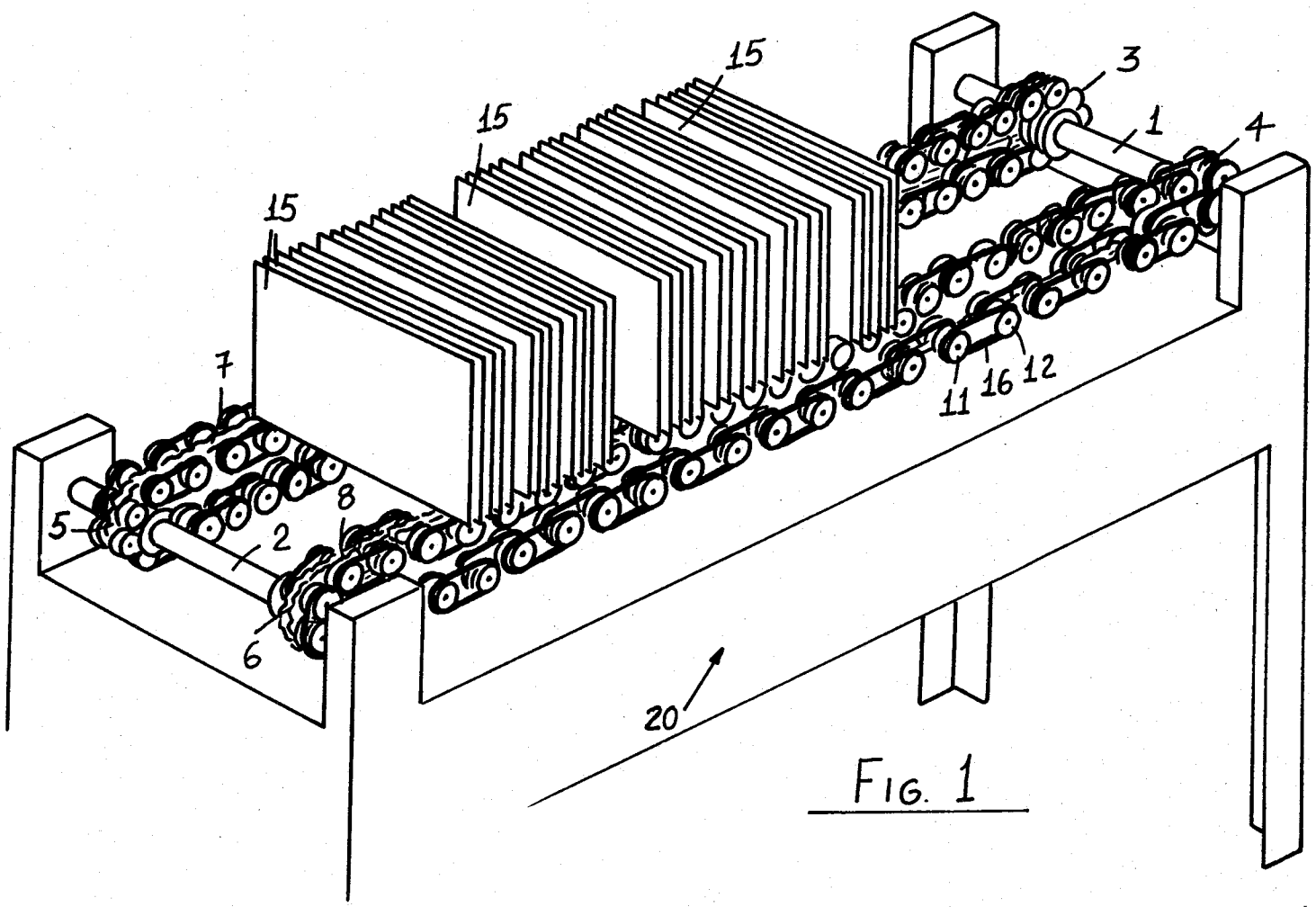
FIG. 1 is a perspective view of an accumulator conveyor device formed as a first embodiment of the present invention.
Figure 2:
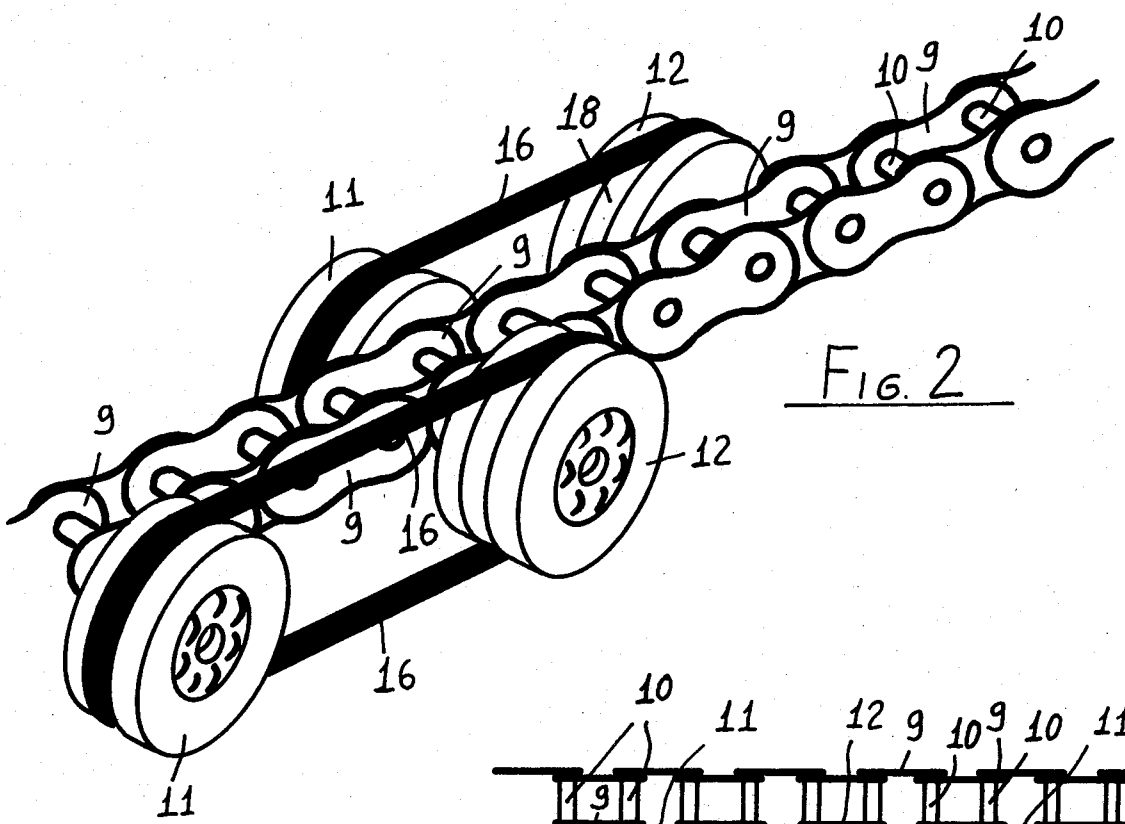
FIG. 2 is a perspective view on an enlarged scale of a conveyor chain constituting an integral part of the embodiment of FIG. 1, provided with pairs of pulleys on opposite sides of the chain.

With reference to the accompanying drawings, the accumulator conveyor shown acts as an accumulation device for stacks of signatures and as a device for conveying such signatures towards the subsequent working operations. The device comprises a support frame carrying a pair of shafts 1 and 2, disposed horizontally and each supporting a pair of sprockets 3,4, and 5, 6, over which pass special conveyor chains 7 and 8 made to advance at a suitable speed by driving members (not shown), of conventional type.

The conveyor chains 7 and 8 are constituted by articulated links 9 pivotally connected by articulation pins 10.

The articulated links 9 support, in their turn, pairs of pulleys 11 and 12 suitably spaced and disposed on the same side, or alternatively, on opposite sides with respect to the articulated links 9 of the chains 7 and 8.

Figure 3:
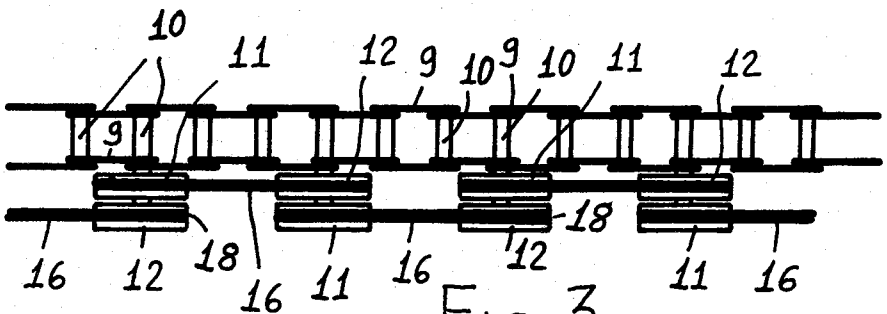
FIG. 3 is a plan view of an alternative form of conveyor chain suitable for use in the accumulation conveyor of the present invention.

In the embodiment of FIG. 3 in which the pairs of pulleys 11 and 12 are disposed both on the same side of the chain links 9, each pulley has a groove 18 and is independent in such a manner that, whenever a pulley turns in a sense opposite to that of advancement of a chain 7 and 8 by the effect of the accumulation of signatures 15 positioned downstream of the device 20, such rotation is not transmitted to the pulleys behind, enabling each pulley to turn entirely independently.

Adjacent pairs of pulleys 11 and 12 are joined by a loop of flexible linear form, which may be a belt or a web or a wire or a cable or a chain 16 which can turn about the linked pair of pulleys and act to transmit movement to the overlying signatures in the direction of motion of the chain of links 9, 10 unless the signatures are subjected to a restraining force, in which case the chains 9, 10 can continue to turn whilst applying only a very gentle pressure to the signatures in the intended direction of movement.

The pulleys 11 and 12 are preferably provided with bearings for the purpose of limiting the friction, although the degree of friction involved in the rotation of the pulleys may be determined by means of suitable adjustable friction devices.

These latter, for an optimum operation of the device, and in dependence on specific and particular requirements, can be adjusted to vary the friction applied to the pulleys against rotation.

The pulleys 11 and 12 are not fitted to every link 9 of the chain, but are suitably spaced in such a way as to be carried on spaced links 9, and further must have a diameter such that the belts 16 lodged in the grooves 18 are higher than the top of the chains 7 and 8 so that the signatures contact only the belts 16 and the surfaces of the pulleys 11, 12 and do not contact the underlying chains.

In use the chains 7, 8 are made to advance at a greater speed than that of the conveyor of the machine positioned downstream so that the signatures tend to accumulate at the output end.

It is suitable to underline that the device in question can be connected to any type of machine usable in the graphic sector, paper technology or packaging in general which requires an accumulation system. The device of the invention can be applied also to the output of the said machines.

Although an embodiment having two chains 7, 8 has been described, it will be appreciated that a different number may be employed (more or less) and that each chain constitutes a continuous support element for the various signatures 15 disposed sideways.

What is claimed is:

1. An accumulator conveyor device for simultaneously conveying and accumulating packs of signatures for feeding to a subsequent working stage, comprising a support structure;

a pair of horizontally disposed shafts carried by said support structure;

two pairs of sprockets, one pair carried by each said horizontally disposed shaft;

a pair of conveying chains each said chain being carried by a respective pair of said sprockets and being constituted by a plurality of articulated links pivotally connected by articulation pins, and a plurality of pairs of pulleys, each said pair of pulleys being carried by a respective said articulation pin, said pulleys being interconnected in longitudinally adjacent pairs by loop members defining support surfaces for said packs of signatures.

2. The device of claim 1, wherein said pulleys of each pair are on opposite sides of each of said links of each of said chains on which they are carried.

3. The device of claim 1, wherein said pulleys of each pair are both disposed on the same side of each of said links of each of said chains on which they are carried.

4. The device of claim 3, wherein said pulleys of each pair are independently turnable about a same spindle constituted by each of said articulation pins of each of said links on which said pulleys are carried.

5. The device of claim 1, wherein said loop members joining said pairs of longitudinally adjacent pulleys are flexible belts, webs, wires, cables or chains.

6. The device of claim 1, wherein said pulleys are provided with adjustable friction devices for determining the resistance to turning of said pulleys.

7. The device according to claim 3 wherein each of said pulleys has a groove, adjacent pairs of pulleys are joined by belts, said belts being lodged in each of said grooves, and said belts are positioned higher than the top of said chains.

* * * * *